US012799947B2

(12) United States Patent
Baer et al.

(10) Patent No.: US 12,799,947 B2
(45) Date of Patent: Nov. 17, 2026

(54) IMPELLER FOR A FAN

(71) Applicant: ebm-papst Mulfingen GmbH & Co. KGaA & Co. KG., Mulfingen (DE)

(72) Inventors: Martin Baer, Mulfingen (DE); Erhard Gruber, Satteldorf (DE); Jens Müller, Künzelsau (DE); Eugen Nasarkin, Neckarsulm (DE); René Acker, Boxberg (DE)

(73) Assignee: EBM-PAPST MULFINGEN GMBH & CO. KGAA & CO. KG, Mulfingen (DE)

( * ) Notice: Subject to any disclaimer, the term of this patent is extended or adjusted under 35 U.S.C. 154(b) by 0 days.

(21) Appl. No.: 19/304,902

(22) Filed: Aug. 20, 2025

(65) Prior Publication Data

US 2026/0055776 A1 Feb. 26, 2026

(30) Foreign Application Priority Data

Aug. 20, 2024 (DE) ..... 10 2024 123 702.3

(51) Int. Cl.
*F04D 29/28* (2006.01)
*F04D 17/16* (2006.01)
(Continued)

(52) U.S. Cl.
CPC ..... *F04D 29/281* (2013.01); *F04D 29/30* (2013.01); *F04D 17/16* (2013.01)

(58) Field of Classification Search
CPC ..... F04D 29/30; F04D 29/281; F04D 29/282; F04D 19/002; F04D 17/08; F04D 17/16;
(Continued)

(56) References Cited

U.S. PATENT DOCUMENTS 6,860,715 B2 * 3/2005 Sekularac ..... F04D 29/681 415/115
8,784,060 B2 * 7/2014 Iwata ..... F04D 29/282 416/185
(Continued)

FOREIGN PATENT DOCUMENTS

DE 112020007795 T5 9/2023
DE 112023001908 T5 3/2025
(Continued)

OTHER PUBLICATIONS

European Search Report for EP Application No. 25195429.3; Mailing date, Jan. 16, 2026, 20 pages.
(Continued)

*Primary Examiner* — Eric J Zamora Alvarez
(74) *Attorney, Agent, or Firm* — CANTOR COLBURN LLP

(57) ABSTRACT

The present disclosure refers to an impeller having two support parts and multiple impeller blades that are arranged between the two support parts and that are connected along a first longitudinal edge with the first support part and along a second longitudinal edge with the second support part. An outer edge of each impeller blade connects the two longitudinal edges, and comprises an edge recess, where the outer edge has a local low point. The position of low point is closer to the support part in which higher internal stresses or loads occur during operation of the impeller.

13 Claims, 2 Drawing Sheets

(51) Int. Cl.
*F04D 29/26* (2006.01)
*F04D 29/30* (2006.01)

(58) Field of Classification Search
CPC .... F04D 17/00; F04D 29/325; F04D 29/4226; F05D 2240/303; F05D 2240/304; F05D 2250/70; F05D 2250/713; F05D 2240/305; F05D 2240/306; F01D 5/048; F24F 1/0022
See application file for complete search history.

(56) References Cited

U.S. PATENT DOCUMENTS

| | | | | |
|---|---|---|---|---|
| 9,829,004 | B2 * | 11/2017 | Ikeda | F04D 29/384 |
| 9,995,311 | B2 * | 6/2018 | Son | B21D 11/20 |
| 10,119,553 | B2 * | 11/2018 | Son | F04D 29/403 |
| 10,550,854 | B2 | 2/2020 | Lörcher et al. | |
| 2004/0213661 | A1 * | 10/2004 | Sekularac | F04D 29/681 415/58.4 |
| 2015/0316073 | A1 | 11/2015 | Lrcher et al. | |
| 2023/0332615 | A1 | 10/2023 | Asano et al. | |
| 2024/0410375 | A1 * | 12/2024 | Inoue | F04D 17/08 |

FOREIGN PATENT DOCUMENTS

| | | | |
|---|---|---|---|
| EP | 2942531 | A1 | 11/2015 |
| EP | 3591234 | A1 | 1/2020 |
| EP | 3660405 | A1 | 6/2020 |
| EP | 3660405 | B1 | 9/2021 |
| JP | 2011226448 | A | 11/2011 |
| JP | 2013096378 | A | 5/2013 |

OTHER PUBLICATIONS

German Office Action corresponding to DE Application No. 10 2024 123 702.3; Mailing Date, Jul. 7, 2025, 4 pages.
German Office Action corresponding to DE Application No. 10 2024 123 702.3; Issue date, Aug. 13, 2026, 30 pages.

* cited by examiner

IMPELLER FOR A FAN

CROSS REFERENCE TO RELATED APPLICATIONS

This application claims priority under 35 U.S.C. § 119 to the following German Patent Application No. 10 2024 123 702.3, filed on Aug. 20, 2024, the entire contents of which are incorporated herein by reference thereto.

TECHNICAL FIELD

The present disclosure refers to an impeller for a fan. During operation of the fan the impeller is rotatingly driven around a rotation axis and thereby creates a flow, for example a gas flow, particularly an air flow. The fan can be configured as radial fan or diagonal fan.

BACKGROUND

The impeller has a first support part, a second support part and impeller blades arranged between the two support parts, wherein the impeller blades are connected to the first support part along a first longitudinal edge and to the second support part along a second longitudinal edge. Mechanical stresses and strength requirements increase with increasing rotational speed, wherein the total stress can increase in quadratic manner with the rotational speed. This can be addressed by a more stable configuration, for example with higher wall thicknesses, at least in the highly stressed areas. Thereby, however, the impeller gets heavier and more expensive. The energy consumption of the fan also increases, particularly if the impeller is accelerated for changing the rotational speed.

EP 2 942 531 A1 shows an impeller for a fan having multiple blades that extend between a cover disc and a bottom disc. Each blade has a curved back edge arranged with distance to a cord connecting the corners of the back edge. The back edge has a curved extension, however, without recess.

DE 11 2023 001 908 T5 shows an impeller having blades that respectively have a tip at the back edge in the middle between the support parts.

An impeller is known from DE 11 2020 007 795 T5 having blades the back edges of which are curved, but do not comprise a recess.

BRIEF SUMMARY

It can be considered as object of the present disclosure to provide an impeller that withstands increasing mechanical stress without increased material usage.

Disclosed is an impeller for a fan including: a first support part, a second support part that is arranged with distance to the first support part with view parallel to a rotation axis of impeller, multiple impeller blades that extend between the first support part and the second support part and the multiple impeller blades are attached to the first support part by a first longitudinal edge and the multiple impeller blades are attached to the second support part by a second longitudinal edge, wherein an outer edge of each impeller blade of the multiple impeller blades extends between a first connection point at a transition to the first longitudinal edge and a second connection point at a transition to the second longitudinal edge and wherein compared to a virtual connecting straight line extending through the first connection point and the second connection point the outer edge limits an edge recess and wherein the outer edge has a larger distance to a rotation axis of the impeller than an inner edge of a corresponding one of the multiple impeller blades connecting the first longitudinal edge and the second longitudinal edge on a side opposite of the outer edge, wherein the first longitudinal edge comprises a first length, wherein an impeller blade height of the multiple impeller blades is defined by a distance measured parallel to the virtual connecting straight line between the first connection point and the second connection point, wherein the edge recess comprises a local low point comprising a low point distance from the virtual connecting straight line that is measured orthogonal to the virtual connecting straight line, wherein a first height defines a distance of the local low point from the first longitudinal edge that is measured parallel to the virtual connecting straight line and a second height defines a distance of the local low point from the second longitudinal edge that is measured parallel to the virtual connecting straight line, and wherein the first height is smaller than the second height.

The impeller according to the present disclosure is configured for rotation around a rotation axis. In the installed condition the impeller is part of a fan, the motor of which drives the impeller around the rotation axis, in order to create a fluid flow, particularly a gas flow and preferably an air flow. The fan can be a radial fan or a diagonal fan.

The impeller has a first support part and a second support part. The support parts are arranged with distance to one another in axial direction-parallel to the rotation axis. Between the two support parts, the impeller has multiple impeller blades. The impeller blades are connected to the first support part by means of a first longitudinal edge and to the second support part by means of a second longitudinal edge. Preferably the longitudinal edges are curved. Further preferably the longitudinal edges are not congruent with view in axial direction.

In a preferred embodiment the attachment of the impeller blades to the support parts is achieved by means of a substance bond or an adhesive bond. This connection between the impeller blades and the support parts can be created by means of a welded connection, for example. The impeller blades and/or the support parts can consist of a metallic alloy, for example an aluminum alloy, or a plastic material or a composite material.

In an embodiment the impeller blades and the support parts can form a monolithic body.

For example, the first support part can be a bottom disc of the fan and the second support part can be a cover disc of the fan. In the area of the bottom disc of the fan the motor of the fan can be arranged in the installed condition.

The two support parts are preferably uneven. The two support parts preferably have a non-identical geometry. The first support part can comprise one or more beads for increasing strength. The second support part can have a corrugated geometry.

Each impeller blade has an inner edge as well as an outer edge. The inner edge and the outer edge connect the two longitudinal edges on opposite sides. The outer edge has a larger radial distance to the rotation axis than the inner edge.

In the transition to the first longitudinal edge the outer edge has a first connection point and in the transition to the second longitudinal edge the outer edge has a second connection point. At the first connection point, the first longitudinal edge is in contact with the first support part. At the second connection point the second longitudinal edge is in contact with the second support part.

The outer edge limits an edge recess of the impeller blade. In the extension direction of the respective impeller blade with view from the inner edge to the outer edge the impeller blade has a reduced length in the area of the edge recess. Compared with a virtual connecting straight line through the first connection point and the second connection point the outer edge has a distance to the connecting straight line in the area of the edge recess. The edge recess is preferably unsymmetrically starting from a low point at which the edge recess has the longest distance to the connecting straight line.

Outside of the edge recess the outer edge can extend along the connecting straight line or can extend on the opposite side of the straight line compared to the edge recess and can form an edge projection, so-to-speak. In a preferred embodiment the outer edge does not extend through the virtual connecting straight line, so that no edge projection is present.

Due to the formed edge recess at the outer edge on the impeller blades, their stiffness is reduced, but interior stresses during operation of the impeller in the area of the connection between the impeller blades and the first support part and/or the second support part are remarkably reduced. In doing so, it can be achieved that the impeller can be used for fans having a higher maximum rotational speed without the requirement to increase the material thicknesses of the support parts and/or the impeller blades.

By means of the configuration according to the present disclosure rotational speed increases of minimum 8% to 9% and up to over 25% can be achieved compared with impellers having a comparable size. The impellers are suitable for rotational speeds of minimum 3,500 rotations per minute up to 4,350 rotations per minute in case of smaller sizes in the range of up to 450 mm diameter. For impellers with sizes of 500 mm diameter and more, rotational speeds of minimum 2,300 rotations per minute and up to 2,900 or 3,000 rotations per minute can be achieved.

Along their particularly curved extension between the inner edge and the outer edge the first longitudinal edge has a first length. Analog to this the second longitudinal edge has a second length from the inner edge to the outer edge. The lengths of the longitudinal edges are measured between the connection points at which the longitudinal edges transition into the inner edge or the outer edge and at which they are in contact with the first support part or the second support part. For the outer edge these are the first connection point and the second connection point as explained above. The inner edge forms a third connection point at the transition to the first longitudinal edge and a fourth connection point at the transition to the second longitudinal edge. Thus, the first longitudinal edge extends between the first connection point and the third connection point and the second longitudinal edge extends between the second connection point and the fourth connection point.

Along the virtual straight line, the first connection point has a distance from the second connection point, which defines an impeller blade height.

The edge recess has a local low point and preferably exclusively one single local low point. At the local low point the outer edge has a low point distance to the connecting straight line with view orthogonal to the connecting straight line. With view parallel to the virtual connecting straight line the local low point has a distance from the first longitudinal edge defining a first height. The distance of the local low point from the second longitudinal edge with view parallel to the virtual connecting straight line defines a second height. The first height and the second height are different from each other.

It is preferred if the low point distance has an amount of minimum 2.5% or minimum 5.0% or minimum 7.5% or minimum 10% of the first length. Additionally or alternatively, the low point distance can have an amount of maximum 25% or maximum 20% or maximum 15% or maximum 12.5% of the first length.

For example, the low point distance can be in one of the following ranges, including the range limits respectively: 2.5% up to 25% of the first length or 2.5% up to 20% of the first length or 5.0% up to 15% of the first length or 7.5% up to 12.5% of the first length.

The first height has preferably an amount of minimum 5.0% or minimum 7.5% or minimum 10% or minimum 15% of the impeller blade height. Additionally or alternatively, the first height has an amount of maximum 40% or maximum 30% or maximum 25% or maximum 20% or maximum 17.5% of the impeller blade height.

The first height can be preferably in one of the following ranges, including the range limits respectively: 5.0% up to 40% or 7.5% up to 30% or 10% up to 25% or 10% up to 20% or 15% up to 20% of the impeller blade height.

In a preferred embodiment along the edge recess the outer edge has a first edge section that is curved in concave manner and a second edge section that is curved in concave manner, which preferably directly adjoin one another and the maximum curvatures of which have different amounts. The two edge sections directly adjoin each other at the local low point in an embodiment.

Preferably the outer edge is configured without edges and/or without steps. In mathematical terms the extension of the outer edge can be constant and differentiable.

In an embodiment a third edge section that is curved in convex manner can adjoin the first edge section that is curved in concave manner. Additionally or alternatively, a fourth edge section that is curved in convex manner can adjoin the second edge section that is curved in concave manner.

It is advantageous if at least one of the edge sections that is curved in convex manner (for example third and/or fourth edge section) is adjoined by a further edge section that is curved in concave manner, that means, for example, a fifth edge section that is curved in concave manner and/or a sixth edge section that is curved in concave manner.

Here it is explicitly advised that the numbering of features only serves for their distinctiveness and does not indicate a sequence or prioritization. For example, the mentioning of a sixth edge section does not require that a fifth edge section is also present.

The position of the edge recess or the local low point closer to the first support part reduces particularly stresses in the connection area between the first support part and the impeller blade. This is particularly advantageous if during operation of the impeller higher stresses occur in the first support part than in the second support part. Depending on the embodiment the first support part can be the bottom disc and the second support part can be the cover disc of the impeller or alternatively vice versa.

BRIEF DESCRIPTION OF THE DRAWINGS

Advantageous embodiments of the present disclosure are derived from the dependent claims, the description and the drawing. In the following the disclosure is explained in detail based on the attached drawing. The drawing shows:

DETAILED DESCRIPTION

Figure 1:
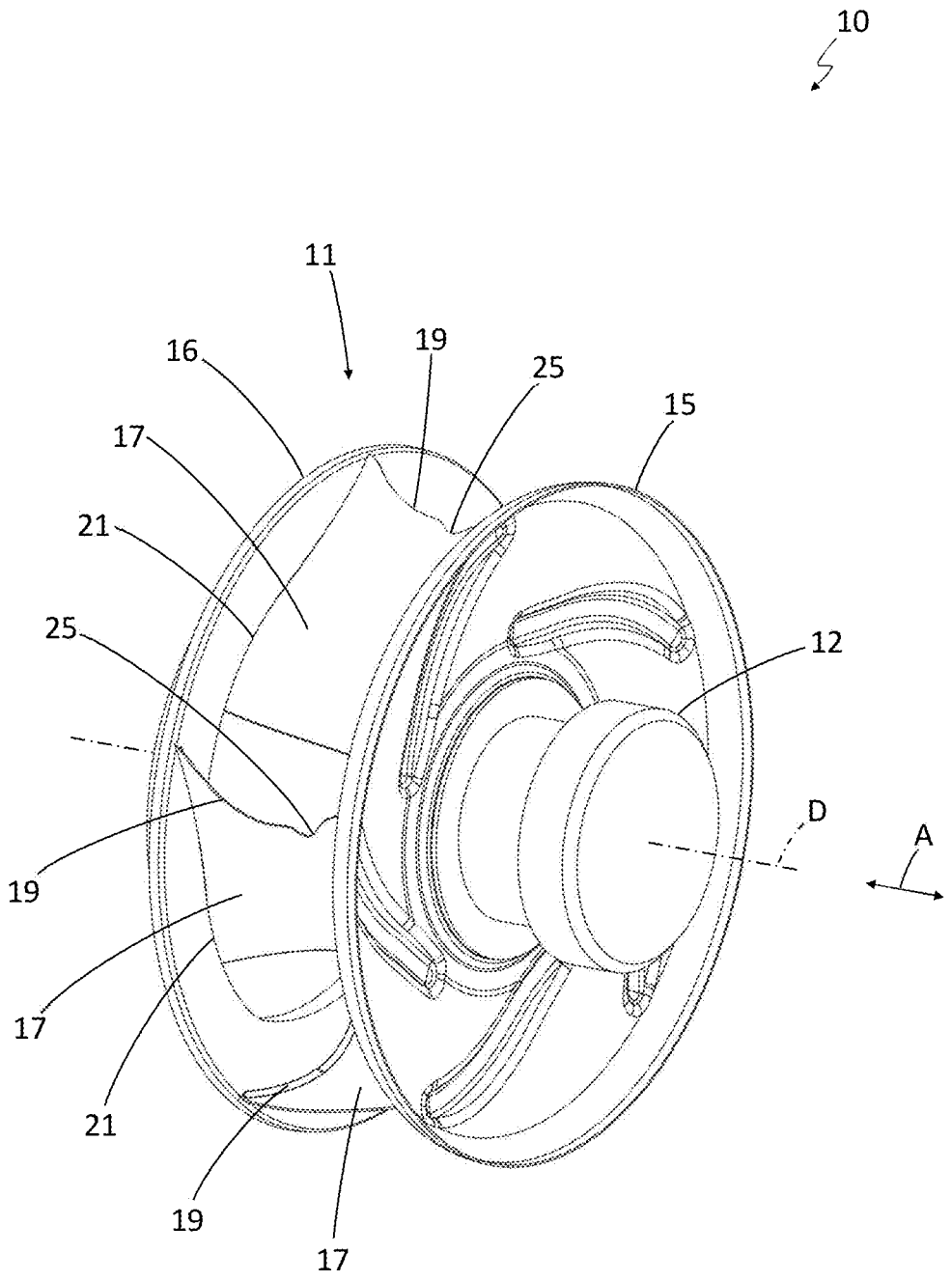
FIG. 1 a schematic perspective illustration of a fan having an embodiment of an impeller according to the present disclosure and FIGS. 2 and 3 an illustration in part of an embodiment of an impeller in the area of the impeller blades in each case in a perspective illustration.

In FIG. 1 a fan 10 (for example radial or mixed flow fan) is schematically illustrated, which comprises an impeller 11 according to an embodiment according to the present disclosure. The impeller 11 is configured for rotation around a rotation axis D. For rotation of the impeller around rotation axis D fan 10 comprises an electric motor 12.

The impeller 11 comprises a first support part 15, a second support part 16 and multiple impeller blades 17. The impeller blades 17 are arranged between first support part 15 and second support part 16, wherein the two support parts 15, 16 are arranged with distance to each other in an axial direction A that is orientated parallel to the rotation axis D. The impeller blades 17 are arranged with distance to the rotation axis D and extend in curved manner from an inner edge 18 to an outer edge 19. The inner edge 18 of each impeller blade 17 has a smaller distance to the rotation axis D than the outer edge 19.

Each impeller blade 17 further comprises a first longitudinal edge 20 as well as a second longitudinal edge 21. The two longitudinal edges 20, 21 are arranged with distance to one another in axial direction A and are with view in axial direction preferably not congruent. Along the first longitudinal edge 20 the impeller blade 17 is connected to the first support part 15. Along the second longitudinal edge 21 the impeller blade 17 is connected to the second support part 16.

The first support part 15 can be a bottom disc and the second support part 16 can be a cover disc or also vice versa. For example, the first support part 15 is arranged next to motor 12 of fan 10, while the second support part 16 is present at the inflow side of fan 10, that is upstream of the second support part 15.

The transition from first longitudinal edge 20 to outer edge 19 forms a first connection point X1. The transition from second longitudinal edge 21 to outer edge 19 forms a second connection point X2. The transition from the first longitudinal edge 20 into inner edge 18 forms a third connection point X3. The transition from second longitudinal edge 21 to inner edge 18 forms a fourth connection point X4. At the connection points X1 to X4 the longitudinal edges 20 or 21 are connected with the respectively assigned support part 15 or 16.

The connection between the impeller blade 17 and the support parts 15, 16 is realized by means of a substance bond connection according to the example, for example a welded connection. Additionally or alternatively, also an adhesive connection using an adhesive can be realized. In a modified embodiment the two support parts 15, 16 and the impeller blade 17 are configured as monolithic body and thus seamlessly.

A virtual connecting straight line G extends through first connection point X1 (transition from the first longitudinal edge 20 to the outer edge 19) and the second connection point X2 (transition from the second longitudinal edge 21 to the outer edge 19). Along the connecting straight line G the distance between the first connection point X1 and the second connection point X2 defines an impeller blade height S. Along the first longitudinal edge 20 the impeller blade 17 has a first length L1 between first connection point X1 and third connection point X3. Along the second longitudinal edge 21 the impeller blade 17 has a second length L2 between second connection point X2 and fourth connection point X4.

Compared to the virtual connecting straight line G the outer edge 19 is depressed at least at one position and limits there an edge recess 25. The edge recess 25 is configured in concave manner with view from the connecting straight line G and comprises a local low point P.

The local low point P has a low point distance T from the connecting straight line G in direction orthogonal to the connecting straight line G. With view parallel to the connecting straight line G the low point P has a distance from the first connection point X1 that defines a first height H1 and a distance to the second connection point X2 that defines a second height H2. The sum of first height H1 and second height H2 corresponds to the impeller blade height S. The first height H1 is particularly smaller than the second height H2.

Preferably, the first height H1 has an absolute value of minimum 5.0% or minimum 7.5% or minimum 10% or minimum 15% of the impeller blade height S. Preferably, the first height H1 has an absolute value of maximum 40% or maximum 30% or maximum 25% or maximum 20% or maximum 17.5% of the impeller blade height S. The indicated minimum values and maximum values can be combined arbitrarily with each other.

It is preferred if the low point distance T has an amount of minimum 2.5% or minimum 5.0% or minimum 7.5% or minimum 10% of the first length L1. Preferably, the low point distance T has an amount of maximum 25% or maximum 20% or maximum 15% or maximum 12.5% of first length L1. The minimum values and maximum values can be arbitrarily combined with one another.

It is preferred if the outer edge 19 comprises only one single low point P the low point distance T of which is inside the indicated range. Preferably, the outer edges 19 have a progress in which they only limit one single low point P or if multiple local low points P are present, the low points P have low point distances T that are different from each other.

Figure 2:
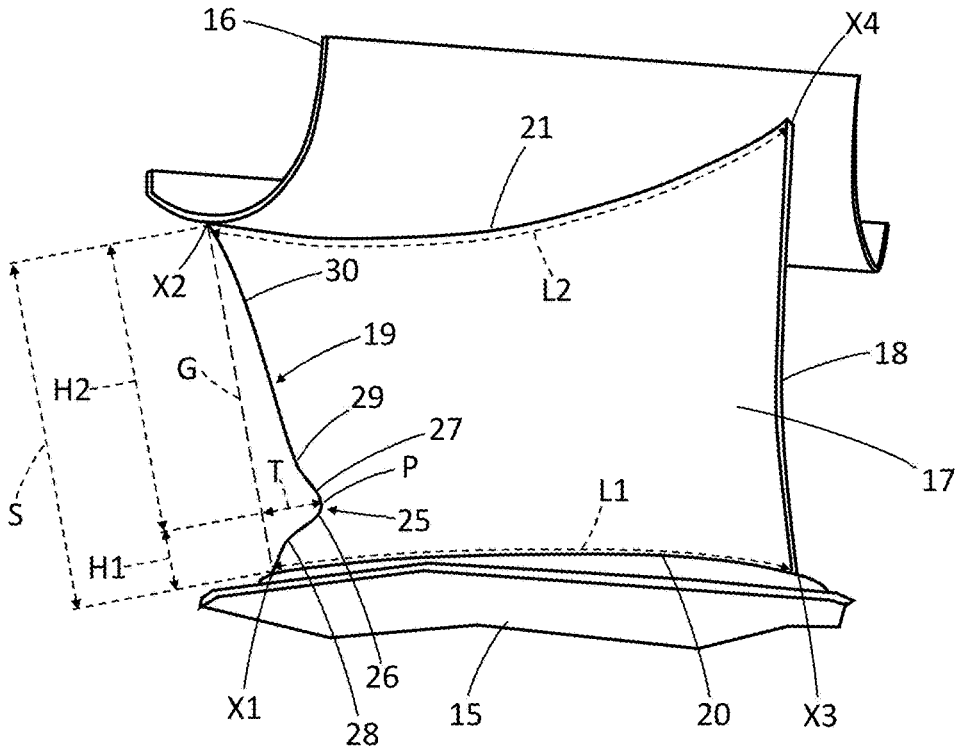
Figure 3:
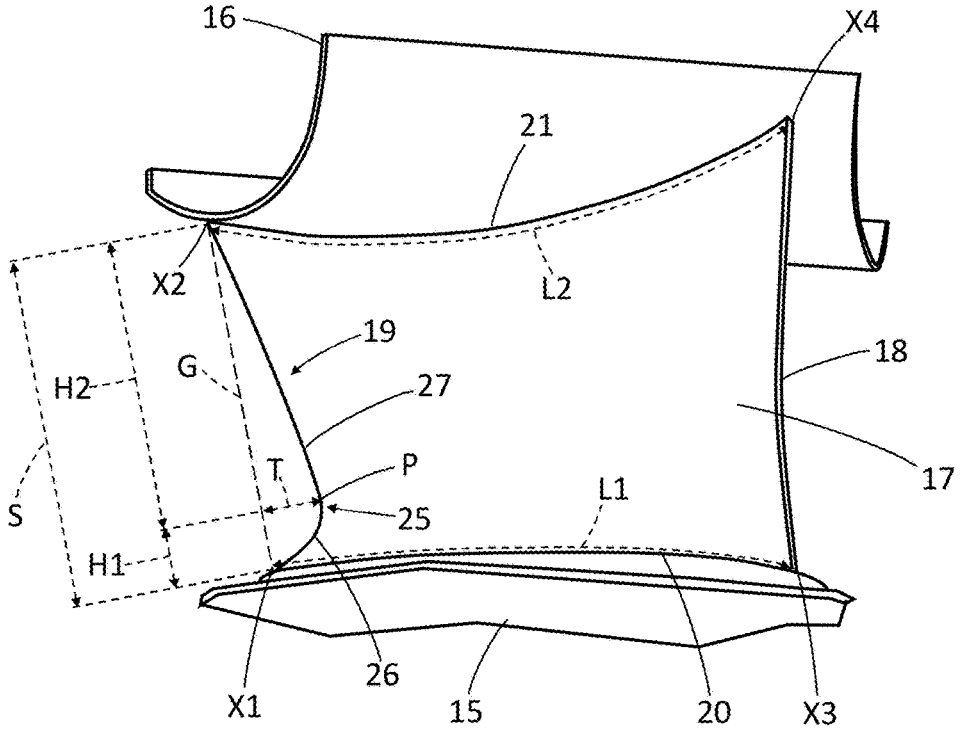

In the embodiments illustrated in FIGS. 2 and 3 starting from the low point P the outer edge has a first edge section 26 on the side toward the first longitudinal edge and a second edge section 27 on the side toward the second longitudinal edge. The first edge section 26 and the second edge section 27 are curved in concave manner and have preferably maximum curvatures of different amount. Preferably, the maximum curvature of first edge section 26 is higher than that of second edge section 27.

Optionally, the outer edge 19 can comprise additional edge sections in addition to first edge section 26 and second edge section 27, for example a third edge section 28 and/or a fourth edge section 29 (FIG. 2). The third edge section 28 can adjoin first edge section 26 and/or fourth edge section 29 can adjoin second edge section 27. The third edge section 28 and the fourth edge section 29 are configured in convex manner with view from the virtual connecting straight line G.

As a further option outer edge 19 can additionally comprise a further edge section that can be curved in concave manner with view from the connecting straight line G, for example a fifth edge section 30. The fifth edge section 30 can adjoin the fourth edge section 29 and/or the second connection point X2.

In modification to the embodiment illustrated in FIG. 2 having concave and convex edge sections, the impeller blade 17 can also have outer edges 19 that only have edge sections curved in concave manner, for example the first edge section 26 and the second edge section 27. Starting from low point P the edge sections 26, 27 can thereby extend up to first connection point X1 or second connection point X2.

The present disclosure refers to an impeller 11 having two support parts 15, 16 and multiple impeller blades 17 that are arranged between the two support parts 15, 16 and that are connected along a first longitudinal edge 20 with the first support part 15 and along a second longitudinal edge 21 with the second support part 16. An outer edge 19 of each impeller blade 17 connects the two longitudinal edges 20, 21 and comprises an edge recess 25, where the outer edge 19 has a local low point P. The position of low point P is closer to the support part 15, 16 in which higher internal stresses or loads occur during operation of the impeller 11.

List of Reference Signs:

| | |
|---|---|
| 10 | fan |
| 11 | impeller |
| 12 | electric motor |
| 15 | first support part |
| 16 | second support part |
| 17 | impeller blade |
| 18 | inner edge |
| 19 | outer edge |
| 20 | first longitudinal edge |
| 21 | second longitudinal edge |
| 25 | edge recess |
| 26 | first edge section |
| 27 | second edge section |
| 28 | third edge section |
| 29 | fourth edge section |
| 30 | fifth edge section |
| A | axial direction |
| D | rotation axis |
| G | connecting straight line |
| H1 | first height |
| H2 | second height |
| L1 | first length |
| L2 | second length |
| P | local low point |
| S | impeller blade height |
| T | low point distance |
| X1 | first connection point |
| X2 | second connection point |
| X3 | third connection point |
| X4 | fourth connection point |

The invention claimed is:

1. An impeller for a fan comprising:

a first support part, a second support part that is arranged spaced apart from the first support part a distance along a direction parallel to a rotation axis of the impeller, multiple impeller blades that extend between the first support part and the second support part and the multiple impeller blades are attached to the first support part by a first longitudinal edge and the multiple impeller blades are attached to the second support part by a second longitudinal edge, wherein an outer edge of each impeller blade of the multiple impeller blades extends between a first connection point at a transition to the first longitudinal edge and a second connection point at a transition to the second longitudinal edge and wherein compared to a virtual connecting straight line extending through the first connection point and the second connection point the outer edge limits an edge recess and wherein the outer edge has a larger distance to the rotation axis of the impeller than an inner edge of a corresponding one of the multiple impeller blades connecting the first longitudinal edge and the second longitudinal edge on a side opposite of the outer edge, wherein the first longitudinal edge comprises a first length, wherein an impeller blade height of the multiple impeller blades is defined by a distance measured parallel to the virtual connecting straight line between the first connection point and the second connection point, wherein the edge recess comprises a local low point comprising a low point distance from the virtual connecting straight line that is measured orthogonal to the virtual connecting straight line, wherein a first height defines a distance of the local low point from the first longitudinal edge that is measured parallel to the virtual connecting straight line and a second height defines a distance of the local low point from the second longitudinal edge that is measured parallel to the virtual connecting straight line, and wherein the first height is smaller than the second height;

wherein the low point distance has an amount of minimum 2.5% and maximum of 12.5% of the first length; and wherein the first height has an amount of maximum 17.5% of the impeller blade height.

2. The impeller according to claim 1, wherein the low point distance has an amount of 2.5% to 25% of the first length or has an amount of 2.5% to 20% of the first length or has an amount of 5.0% to 15% of the first length or has an amount of 7.5% to 12.5% of the first length.

3. The impeller according to claim 1, wherein the first height has an amount of minimum 5.0% or minimum 7.5% or minimum 10% or minimum 15% of the impeller blade height.

4. The impeller according to claim 1, wherein the first height has an amount of 5.0% to 40% or 7.5% to 30% or 10% to 25% or 10% to 20% or 15% to 20% of the impeller blade height.

5. The impeller according to claim 1, wherein along the edge recess the outer edge comprises a first edge section curved in a concave manner and a second edge section curved in a concave manner that adjoin one another and each have maximum curvatures of which have different amounts.

6. The impeller according to claim 5, wherein the first edge section and the second edge section adjoin the local low point of the edge recess.

7. The impeller according to claim 5, wherein a third edge section curved in a convex manner adjoins the first edge section curved in the concave manner.

8. The impeller according to claim 7, wherein a fourth edge section curved in a convex manner adjoins the second edge section curved in the concave manner and a further edge section curved in a concave manner adjoins at least one of the third edge section and the fourth edge section curved in the convex manner.

9. The impeller according to claim 5, wherein a fourth edge section curved in a convex manner adjoins the second edge section curved in the concave manner.

10. The impeller according to claim 1, wherein stresses occurring during operation are higher in the first support part than in the second support part.

11. The impeller according to claim 1, wherein the first support part and the second support part and the multiple impeller blades are connected to one another by a substance bond connection and/or an adhesive connection or wherein the first support part and the second support part and the multiple impeller blades form a monolithic body.

12. The impeller according to claim 1, wherein the first height has an amount of minimum 5.0% or minimum 7.5% or minimum 10% or minimum 15% of the impeller blade height.

13. The impeller according to claim 12, wherein along the edge recess the outer edge comprises a first edge section curved in a concave manner and a second edge section curved in a concave manner that adjoin one another and each have maximum curvatures of which have different amounts.

* * * * *